US005924687A

United States Patent [19]

Hannon

[11] Patent Number: 5,924,687

[45] Date of Patent: Jul. 20, 1999

[54] NEWSPAPER HOPPER AND FEEDER HAVING RAIL-MOUNTED, ONE-WAY ROLLERS

[75] Inventor: Charles Hannon, Olathe, Kans.

[73] Assignee: Stepper, Inc., Olathe, Kans.

[21] Appl. No.: 08/865,575

[22] Filed: Jun. 2, 1997

[51] Int. Cl.[6] ..... B65H 3/06; B65H 3/24

[52] U.S. Cl. ..... 271/116; 271/131; 271/133; 271/137; 271/141

[58] Field of Search ..... 271/18.3, 116, 271/131, 133, 137

[56] References Cited

U.S. PATENT DOCUMENTS

| | | | |
|---|---|---|---|
| 3,734,488 | 5/1973 | Hannon et al. . | |
| 3,762,701 | 10/1973 | Hannon et al. . | |
| 4,557,472 | 12/1985 | Hannon . | |
| 4,702,467 | 10/1987 | Hannon . | |
| 4,715,596 | 12/1987 | Cantrell et al. | 271/116 |
| 4,911,421 | 3/1990 | Hannon . | |
| 4,919,413 | 4/1990 | Hannon . | |

*Primary Examiner*—Boris Milef
*Attorney, Agent, or Firm*—Hovey, Williams, Timmons & Collins

[57] ABSTRACT

A hopper and feeder assembly for feeding newspapers to be collated or assembled for delivery is provided which includes a reciprocating feeder device employing roller clutch and bearing wheel assemblies. The roller clutch and bearing wheel assemblies lock during frictional engagement with the lowermost newspaper in the stack during a forward feed stroke to push the newspaper forward to nip rollers. The narrow feeder device permits a sharp ridge to be formed as the nip rollers snap down to bend the lowermost newspaper in the stack over the wheel assemblies. The roller clutch and bearing wheel assemblies are mounted on a rail to provide a narrow newspaper engagement surface and corresponding narrow ridge formed in the newspaper. During the return stroke, the roller clutch and bearing wheel assemblies are able to remain in contact with the bottommost paper but the free rotating action of the tires as the newspaper is drawn forwardly by the nip rollers does not inhibit feeding, and the next newspaper in the stack is not urged rearwardly but remains static until the next feed stroke.

5 Claims, 3 Drawing Sheets

FIG. 1.
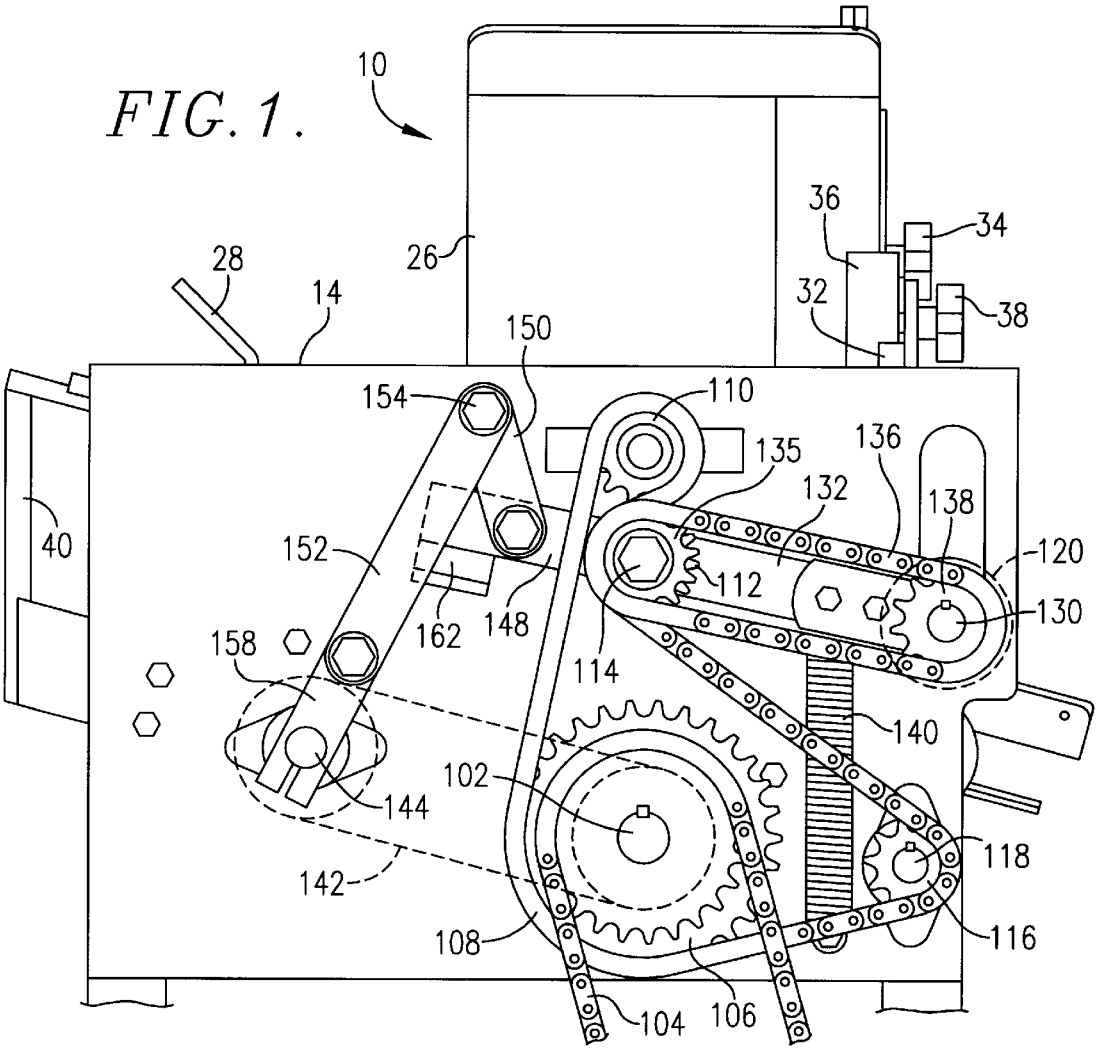
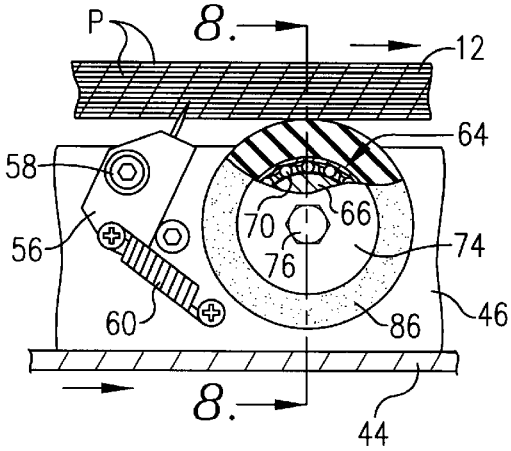
FIG. 6.
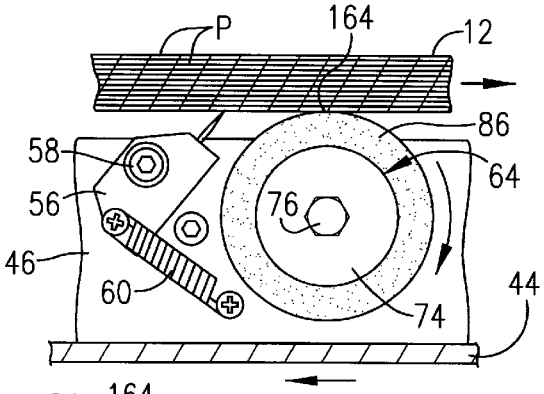
FIG. 7.
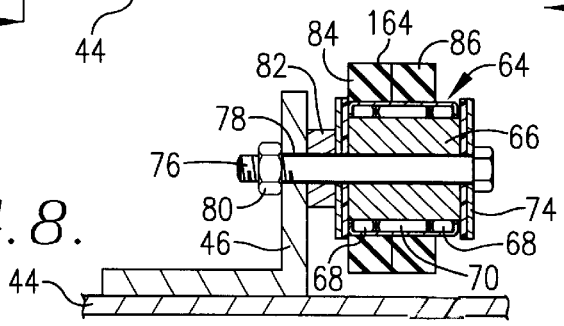
FIG. 8.

3., 4.

10
14
40
28
48
50
20
64
86
84
56
60
58
46
47
26
152
146
160
158
162
148
154
150
156
108
114
132
140
36
38
24
165
30
34
120
122
128
44
130
136
118
3.
4.
-22-

24
24a
26
30
34
36
38
32
14
166
168
170
62
120
56
R
D
F
-22-
130
44
47
42
122
124
46
86a
84a
88
128
118
18

NEWSPAPER HOPPER AND FEEDER HAVING RAIL-MOUNTED, ONE-WAY ROLLERS

BACKGROUND OF THE INVENTION

1. Field of the Invention

This invention concerns a newspaper collator and feeder for delivering newspaper or component sections thereof into a loader path for collation of the components into a finished newspaper. More particularly, it is concerned with an improved metering hopper which provides enhanced separation resistance and is adaptable for use with narrower printed media.

2. Description of the Prior Art

Most newspapers delivered in medium and large cities are bulky and comprised of several sections, each folded midway between their top and bottom margins and nested together. Sunday editions in particular are especially large and bulky, and include inserts such as advertising sections and feature sections which may be slick and thus difficult to handle. Moreover, Sunday newspapers in particular may include a number of sections which are printed well in advance and then assembled with those sections such as news and sports which are printed soon before delivery. In order to assemble the newspaper of multiple different sections at different times for large circulation volumes, automated hoppers are necessary to collate the different sections and combine them into a final newspaper product ready for timely delivery.

One problem associated with feeding the newspaper sections is the friction between the bottommost section in the hopper and the section immediately above it. The friction between adjacent newsprint sections is greater than tabloid inserts printed on slicker paper with ink which causes a sliding effect when positioned between the folded newsprint. Thus, there has been a tendency of the bottommost section in the hopper to have its fold roll back and upwardly as the bottom portion of the jacket or outer page moves forward during feeding. This problem can produce misfeeds in the hopper.

A variety of different sheet feeding hoppers have been used in connection with inserting and feeding newspaper sections. One such device is shown in my U.S. Pat. No. 3,762,701 which issued Oct. 2, 1973. In that device, a driven gear and a gripper both oscillated back and forth and alternately permitted either freewheeling or driving of a gripping roller to engage a stiff sheet. However, the feeder of that mechanism failed to provide satisfactory inhibition to separation of the newspapers in the stack.

Another approach is shown in my U.S. Pat. No. 4,557,472 and 4,702,467, the disclosure of which is incorporated herein by reference. In the disclosure of those two patents, the lowermost section is advanced over a feeder device 18 to provide a ridge in the newspaper section to inhibit separation. The feeder device moves in an inclined generally oval path to successively feed the bottommost newspaper by engaging it with a pair of spaced-apart rubberized pads. In my later U.S. Pat. No. 4,911,421, the disclosure of which is incorporated herein by reference, the separating and feeding member 194 is provided with a single rubberized pad 194*a* which engages the bottommost newspaper. In each of the foregoing devices, the weight of the superposed newspapers above the bottommost newspaper causes the formation of a ridge which extends longitudinally and helps to lock the newspaper section together prior to feeding, thereby resisting the tendency of the jacket or outermost pages of the bottommost newspaper to roll as its upper page surface frictionally engages the newspaper thereabove.

However, despite the improvements in the art made by these devices, occasional problems still arise. One such problem is the need for a more pronounced ridge in the bottom newspaper section just prior to feeding. As newspaper sections become either thicker or narrower due to the use of narrower newsprint pages (e.g. 12 inches instead of 16 inches), an improved ridge is most beneficial in inhibiting the rolling effect described above. When a relatively wide pad is used with a narrow newprint page, there may be difficulty in achieving a ridge sufficient to lock the section together.

Another problem occasionally encountered with the use of the relatively wide pads in the prior art devices is that the pad engages the bottommost newspaper during the upward and rearward movement of the pad. The resulting frictional engagement between the pad and the newspaper section may cause some slight yet significant movement of the bottommost newspaper relative to the newspapers positioned thereon in the stack in the feeder. When this occurs, the second bottommost newspaper section in the stack, with its fold facing forwardly, may slightly overlap and have its fold move in front of the bottommost newspaper section's forwardly facing fold. When this occurs, the forward movement of the pad causes not only the bottommost newspaper section to move forward and feed into the nip rollers of the feeder, but also the newspaper section thereabove, resulting in a double feed.

When these circumstances occur in a high speed newspaper assembling operation, numerous newspapers may be improperly assembled or the machine may jam, resulting in significant delays even though an operator is in immediate attendance. With approaching delivery deadlines and only short periods for assembly, even small delays may be critical.

There has thus developed a need for an improved feeder device for use in connection with machines which collate and assemble articles such as thin paper products and bulky newspaper sections which can automatically handle and reliably feed the articles with a minimum of downtime.

More particularly, there has developed a need for a feeder which substantially eliminates the rolling effect and double feed problems described above.

SUMMARY OF THE INVENTION

These problems have largely been solved by the hopper and feeder of the present invention which is used for feeding sheet articles or assemblies such as newspapers or newspaper sections onto a conveyor or the like. The hopper and feeder of the present invention provide improved feeding of newspapers by providing a narrow ridge line through the use of roller clutch and bearing wheel assemblies to feed the newspapers into nip rollers which snap down to lock the newspaper together. In addition, the roller clutch and bearing wheel assemblies provide improved resistance to double feeding problems by avoiding pulling the lowermost paper in the stack rearwardly.

In greater detail, the hopper and feeder hereof provide a newspaper receiving area defined within front and rear and side retainers. A feeder device is provided which carries a plurality of roller clutch and bearing wheel assemblies. Each of the assemblies is mounted to the rail for one way rotation, whereby the upper surface of tires of the assemblies engage and push the lowermost newspaper section forward during a feed stroke until the nip rollers snap the paper to form a ridge. The ridge is narrow and is especially useful when narrow newspaper sections are to be fed, thereby resisting rolling action of leading edge of the newspaper section as each section is accelerated forwardly away from the remaining sections in the stack. Once engaged, the nip rollers accelerate the lowermost newspaper section forward, with the tires rotating freely on the roller clutch and bearing assemblies as the newspaper section moves past. The feeder then begins its return stroke to receive the next newspaper section. During this return stroke, the free rotation of the tires avoids pushing the next newspaper section rearwardly during any part of its stroke so that other sections thereabove do not enter the stream for double feeding.

The resulting hopper assembly avoids the need for additional drive input to move the newspaper engaging tires into and out of engagement with the newspaper sections. By free rotation of the tires in one direction and resistance to rotation in the other direction, newspapers can be fed more readily without misfeeding.

These and other objects will be appreciated by those skilled in the art after reference to the drawings and the detailed description of the preferred embodiment which follows.

BRIEF DESCRIPTION OF THE DRAWINGS

FIG. 1 is a side elevational view of a newspaper hopper and feeder constructed in accordance with the principles of the present invention;

FIG. 6 is an enlarged, fragmentary view of the hopper and feeder showing the cam roller and needle of the feeder mechanism, with portions of the cover plate of the cam roller broken away to show the internal bearings;

FIG. 7 is an enlarged, fragmentary view of the cam roller and needle similar to FIG. 6, with arrows illustrating the relative movement of the feeder mechanism and the newspaper section; and FIG. 8 is an enlarged, vertical cross-sectional view taken along line 8—8 of FIG. 6.

DESCRIPTION OF THE PREFERRED EMBODIMENT

Figure 2:
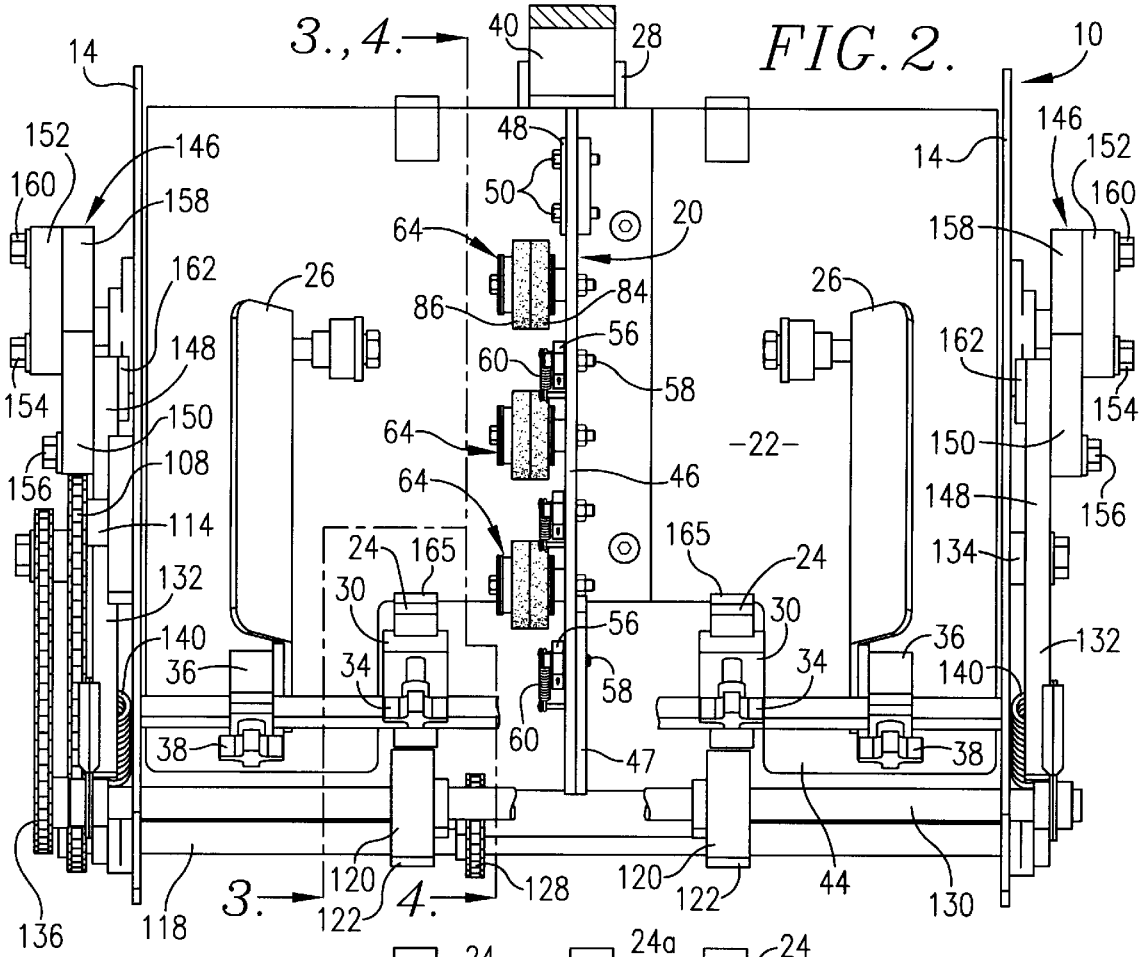
FIG. 2 is a top plan view thereof with the feeder in the rearward and upward newspaper-engaging position.

Referring now to the drawings, and particularly to FIGS. 1 through 5, a metering hopper 10 is shown which is designed for use with a newspaper assembling system as shown in my U.S. Pat. No. 4,911,421, the disclosure of which is incorporated herein by reference. The system is designed to employ multiple hoppers 10, whereby different newspaper sections 12 are fed into the hoppers 10, or from the hoppers 10 onto a common conveyor where they are collated and assembled for final packaging and ultimately for pickup for distribution by the carrier. As used herein, a newspaper section is used to mean a collection of newspaper pages combined together as one or several component sections of a newspaper, or the entire newspaper if collating is not used. Each newspaper section 12 includes a plurality of flat pages P folded to present a transverse fold line F preferably oriented toward the forward end of the hopper 10 to present a leading edge. The newspaper section can include one or a plurality of inner sections tucked within an outer section. The metering hopper 10 is capable of operation either in a continuous mode wherein newspaper sections 12 are continuously fed downstream onto the common conveyor or in an automatic mode for collating component newspaper sections where newspaper sections 12 are fed onto the conveyor only when another section is detected moving downstream along the conveyor so that a plurality of different component sections may be assembled into a completed newspaper.

The metering hopper 10 includes a pair of upright side plates 14 which are structurally interconnected by a rear transverse angle beam 16 and a front transverse bar 18 situated below a reciprocating feeder device 20. An upright newspaper receiving zone 22 is defined in the hopper 10 above the feeder device 20 by a series of spaced, variously adjustable, upright front retainers 24, upright side retainers 26, and a rear retainer 28, all of which are shown in FIG. 2. The front retainers 24 are vertically, slidably carried by respective brackets 30 which, in turn, are attached by upon a transverse retainer bar 32 spanning the two side plates 14. Setscrews 34 associated with the corresponding brackets 30 releasably hold the corresponding front retainers 24 in selected vertical positions of adjustment. The side retainers 26 serves as the lateral confining means for the newspaper sections 12 contained within the zone 22. Such retainers 26 are carried by corresponding brackets 36 which are held in selected positions of adjustment along the retainer bar 32 by setscrews 38. The rear retainer 28, whose primary purpose is to assist in proper positioning of the lowermost newspaper section for unloading from the receiving zone 22, is supported upon a rear bracket 40 attached to and extending upwardly from the rear transverse angle beam 16.

The feeder device 20 is supported for its fore-and-aft reciprocating movement by a set for four rollers 42 locating essentially at the four corners of the device 20, rotatably mounted to the opposite side plates 14 and disposed to provide a downwardly and forwardly inclined attitude for the device. A support structure in the form of a plate 44 rides on top of the rollers 42 and provides a mounting surface for numerous structures, to be described, which function to engage and feed the newspaper sections 12 during hopper operation. To this end, a relatively thin upstanding rail 46 is affixed to the support plate 44 with its longitudinal axis extending in the direction of feed and positioned approximately along the fore-and-aft center line of the hopper 10. The rail 46 extends the full fore-and-aft length of the support plate 44 and mounts a glide 47 preferably of ultra high molecular weight polyethylene or other friction-resistant synthetic resin material. The glide projects upwardly slightly from the remainder of the rail 46 for engaging the bottom surface of the newspaper section 12 as is moves forwardly during feeding.

A pusher 48 is associated with the rail 46 and is located generally adjacent the rear end thereof. The pusher 48 is in the form of a relatively small, rectangular plate affixed to the rail 46 by releasable fasteners 50 which project through an elongated slot 52 in the rail 46. The slot 52 extends in a fore-and-aft direction in parallel relationship to the support plate 44 to enable the pusher 48 to be adjusted fore-and-aft of the rail 46 upon loosening of the fasteners 50 thereof. Such loosening of the fasteners 50 also permits the pusher 48 to be adjustably positioned vertically due to slots 54 in the pusher 48 through which the fasteners 50 also pass. Further, a set of three pivotally mounted, spring-loaded, forwardly-tilted gripping needles 56 are attached to the rail 46 so as to be in position to penetrate the bottommost newspaper section 12 substantially along its center line during the forward reciprocating stroke of the rail 46. Each needle 56 is mounted on a transverse pivot 58 and is yieldably biased by spring means 60 toward the position illustrated in FIGS. 3 and 4 whereby to slightly impale the bottommost newspaper section 12 during forward feed and facilitate such feeding thereof. Upon rearward movement of the feeder device 20, the needles 56 are rocked down clockwise about pivots 58 by the stationery next newspaper section in the stack and have no effect.

Figure 3:
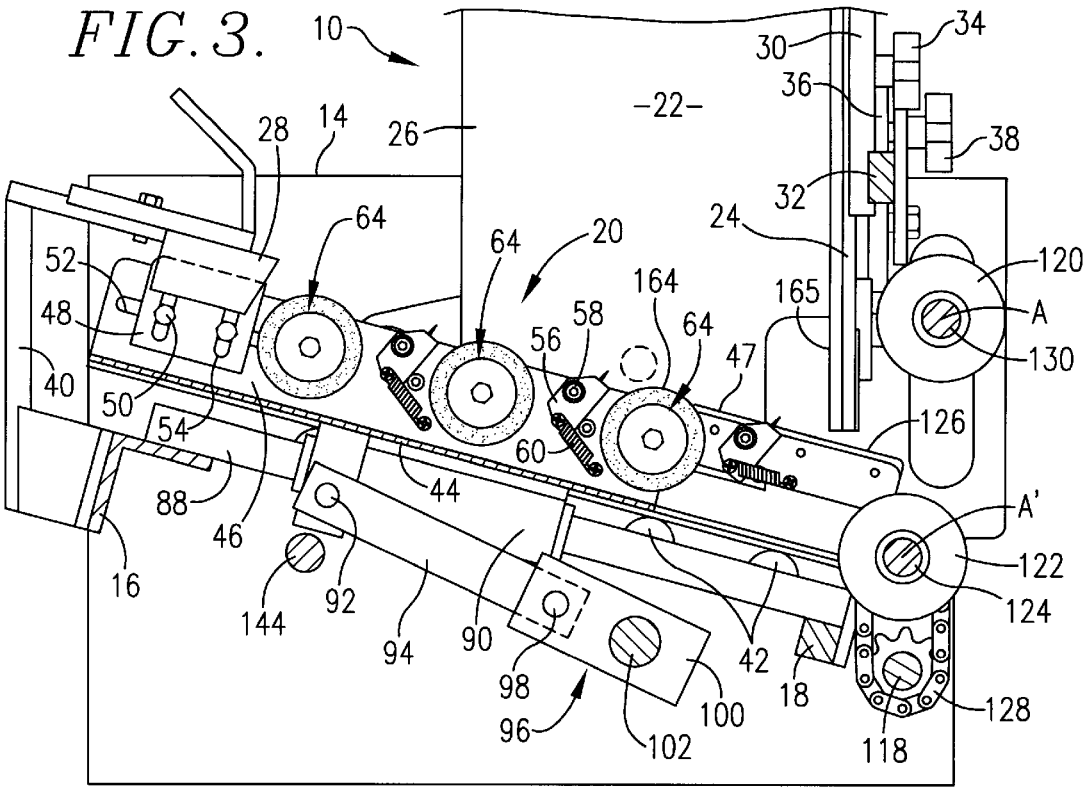
FIG. 3 is a vertical cross-sectional view thereof taken substantially along line 3—3 of FIG. 2 showing the feeder at the beginning of its feed stroke.
Figure 4:
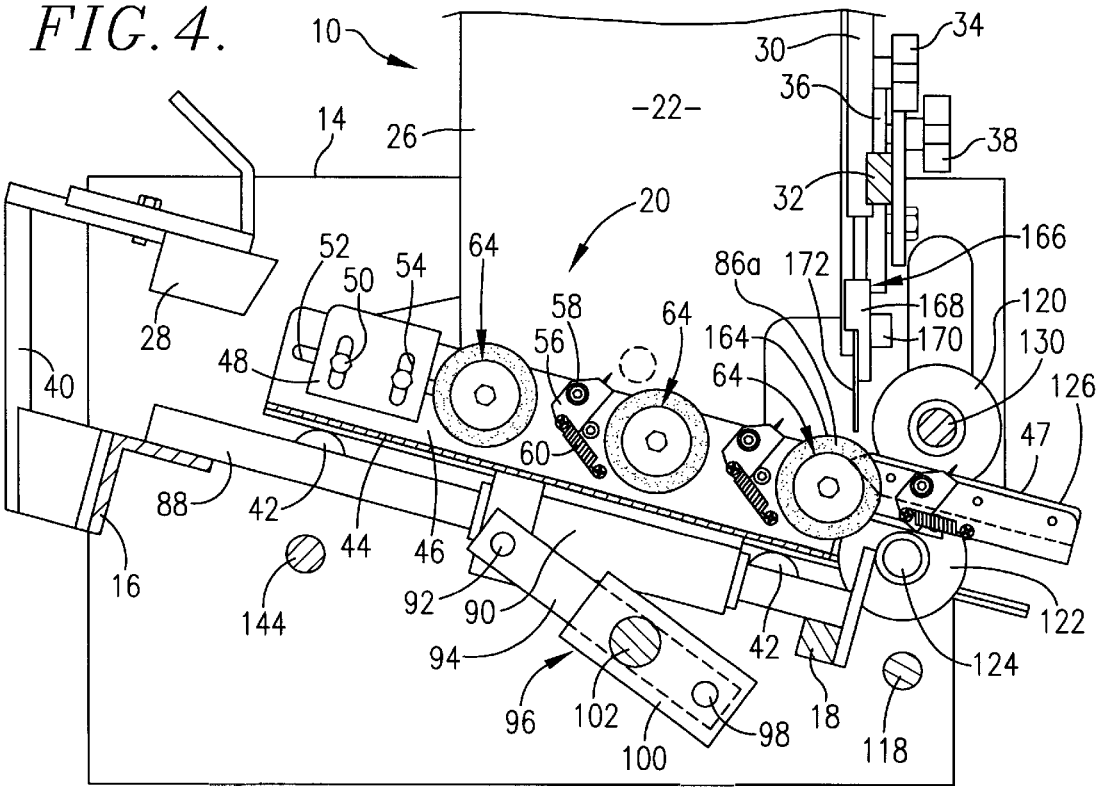
FIG. 4 is a vertical cross-sectional view thereof taken substantially along line 4—4 of FIG. 2 with the feeder in the forward and downward position after the newspaper section has been fed to the nip rollers to begin its return stroke.

Also supported by the plate 44 and connected to the rail 46 are three roller clutch and bearing wheel assemblies 64 constituting and improved feature provided on the metering hopper 10. The assemblies 64 are positioned on the rail 46 rearwardly of the glide 47. The roller clutch and bearing wheel assemblies 64 are mounted for free rotating movement in a clockwise direction as shown in FIGS. 3 and 4, but lock and resist rotational movement in a counterclockwise direction. An exemplary clutch and bearing assembly 64 may be, for example, a Model No. RCB-162117 clutch and bearing assembly by the Torrington Company of Torrington, Connecticut. As shown in FIGS. 6, 7, and 8, the assemblies 64 include a shaft 66 surrounded by roller bearings 68 and spring-loaded lock-up bearings 70 positioned between the roller bearings 68. A hub 72 is positioned radially outwardly of the bearings 68 and 70 and a cover plate 74 is positioned over the side surfaces of the shaft 66 and hub 72. A smooth shank threaded fastener 76, such as a carriage bolt, extends transversely through the center of the shaft then through an opening 78 of the rail 46, receiving thereon a nut 80 for coupling the fastener 76 and bearing assembly 64 to the rail 46. A spacer 82 of friction-resistant synthetic resin material is positioned between the rail 46 and the inboard cover plate 74. Narrow tires 84, 86 of non-marking natural latex or synthetic rubber are positioned in compression radially outboard of the hub 72 for engaging the bottommost newspaper section 12 as shown in FIGS. 6 and 7. The tires 84, 86 promote proper feeding engagement between the feeder device 20 and the bottommost newspaper section 12 throughout the feeding operation as will be subsequently explained.

As illustrated in FIGS. 1 through 5, there is a mechanism provided beneath the support plate 44 for reciprocating the feeder device 20 along its fore-and-aft path including a centrally disposed, fore-and-aft extending guide rod 88 (FIGS. 3, 4 and 5) supported between the rear transverse angle beam 16 and the front transverse bar 18. A sleeve 90 affixed to the bottom of the support plate 44 is slidably received on the guide rod 88 and is connected via pivot 92 to one end of a link 94 forming a part of the drive mechanism, generally designated 96, for the plate 44 and hence also for the feeder device 20 as a whole. The link 94 is also connected at its opposite end by a pivot 98 to a crank 100 clamped onto an input drive shaft 102, as seen in FIGS. 3 and 4, which is powered by a downwardly and forwardly extending drive chain 104 (FIG. 1) leading to a source of power.

As further seen in FIG. 1, the input drive shaft 102 projects outwardly through and beyond one of the side plates 14 (the left one in FIGS. 2 and 5) and on its outermost end carries a large sprocket 106 which delivers rotary power from shaft 102 to an endless chain 108 partially entrained around the sprocket 106. Also, referring to FIGS. 2 and 5, in addition to FIG. 1, the chain 108 is entrained about an upper idler sprocket 110 rotatably mounted to the one side plate 14, is backwrapped around an intermediate idler sprocket 112 fixed on a stub shaft 114 journaled to the side plate 14 and then trained around a lower drive sprocket 116 adjacent the front of the hopper 10 which is carried by a shaft 118 which spans the side plates 14 and is journaled thereby.

Figure 5:
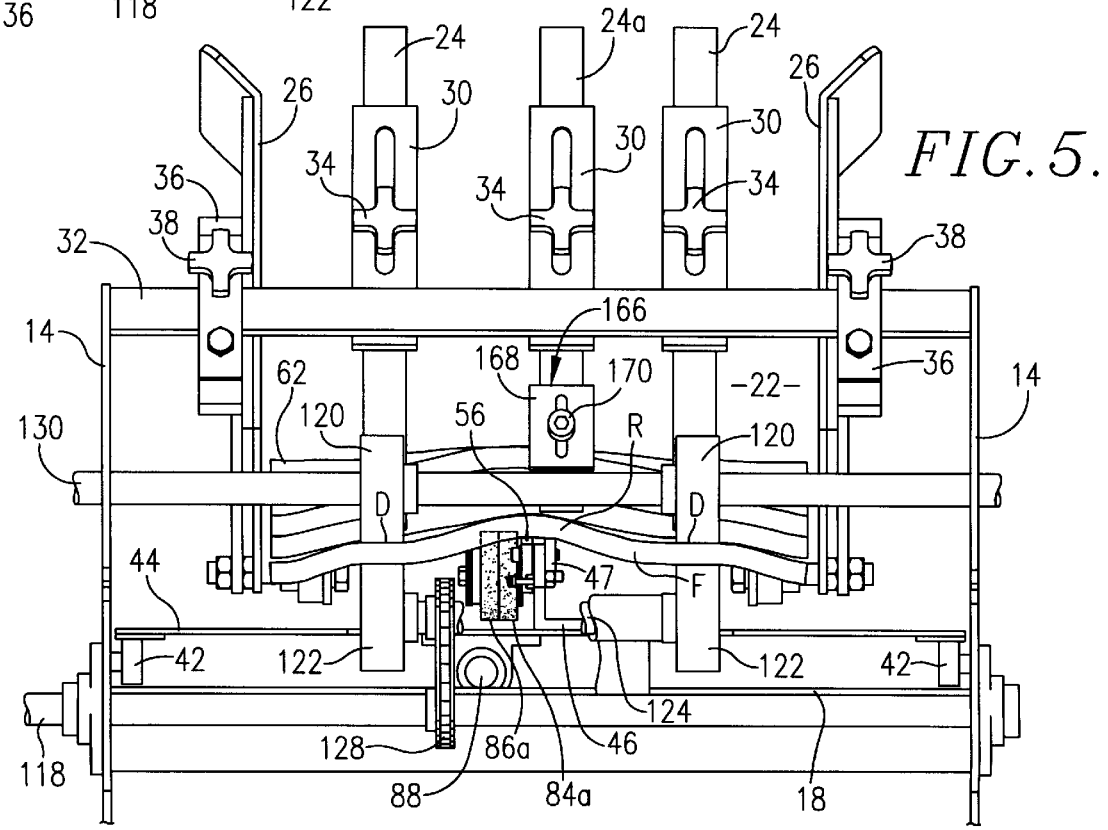
FIG. 5 is an end elevational view thereof taken from the downstream end of the hopper and feeder.

Upper and lower pairs of clamping nip rollers 120 and 122 are provided at the front of the metering hopper 10. The pair of laterally spaced lower nip rollers 122 are carried by a shaft 124 and positioned on opposite sides of the rail 46 and with their upper peripheries below the level of the upper edge 126 of the glide 47 adjacent thereto and therefore below the uppermost surface 164 of the tires 84, 86 on the feeder device 20 even when it is in its retracted position as shown in FIG. 3. As seen in FIG. 5, the shaft 124 is coupled by a chain 128 to the lower driven shaft 118. The pair of correspondingly spaced upper nip rollers 120 are aligned above the lower rollers 122 and carried by another driven shaft 130 which is journaled at its opposite ends to the forward ends of a pair of levers 132 disposed outboard of the side plates 14 of the hopper 10 and pivotally mounted intermediate their opposite ends respectively by the one stub shaft 114 and another stub shaft 134. The upper nip rollers 120 have an axis of rotation A and the lower nip rollers 122 have an axis of rotation A'. The glide 47 extends through the plane between the axes A—A' when the feeder device 20 reaches the forward portion of the feed stroke as shown in FIG. 4, but the tires 84, 86 remain rearwardly of the plane between the axes A—A' at all times.

As seen in FIG. 1, in addition to the intermediate idler sprocket 112, the one stub shaft 114 also carries a drive sprocket 135 being drivingly coupled by a chain 136 to a driven sprocket 138 on one end of the upper roller driven shaft 124. In such manner, the drive sprocket is rotatable about the pivot axis of the levers 132 so that rotary power is transmitted from the sprocket to the driven sprocket 138 even as the levers 132 pivot the upper clamping nip rollers 120 toward and away from the stationarily-positioned lower nip rollers 122. As viewed in FIGS. 1, 3 and 4, the upper nip rollers 120 are driven in a counterclockwise direction, while the lower rollers 122 are driven in a clockwise direction, with both pairs being driven at relatively high speeds. Also, tension springs 140 extending between levers 132 and the plates 14 yieldably biased the levers and thereby the upper rollers 120 toward the lower rollers 122. The upper nip rollers 120 are moved toward and away from the lower nip rollers 122 by the pivotal levers 132 in timed relationship with the feed and return strokes of the support plate 44 of the feeder device 20. This is accomplished by a input drive coupling 142 between input drive shaft 102 and a cross shaft 144 and by linkages 146 interconnecting rear ends 148 of the levers 132 extending rearwardly of the stub shafts 114 and 134 with the opposite ends of the cross shaft 144. Particularly, linkage 146 includes a short upper link 150 and a long lower link 152 pivotally connected together by fastener 154 and respectively pivotally connected to the one lever end 148 by a fastener 156 and to the outer end of a crank arm 158 on each opposite end of the cross shaft 144 by a fastener 160. A stop 162 of rubber on each rear end 148 of the levers 132 limits pivoting of the short link 150 relative to the lever 132 to an aligned position whereby the short link 150 is in alignment with the lever 132. During each revolution of the input drive shaft 102, its crank 100 via link 94 and sleeve 90 moves the support plate 44 through one complete cycle of feed and return strokes. Concurrently, during each revolution of the input drive shaft 102, the cross shaft 144 also makes a revolution and its crank arm 158 moves through one complete cycle of revolution. Once the feed stroke has started and the crank arms 158 have reached a position 108 degrees from that shown in FIG. 1, the short links 150 are aligned with their respective levers 132 such that the levers 132 are at their maximum counterclockwise pivotal displacement which causes separation of the upper nip rollers 120 by the maximum allowable distance from the lower rollers 122 as shown in FIG. 3. As the support plate 44 nears the end of its feed stroke, which is depicted in FIG. 4, the crank arms 158 have rotated 180 degrees to the position shown in FIG. 1 which allows the levers 132 to be moved to their maximum clockwise pivotal displacement by contraction of the tension springs 140. It will be observed that the upper nip rollers 120 remain separated from the lower nip rollers 122 until the leading portion of the bottommost newspaper section 12 has been inserted between the rollers 120 and 122. Thus, no gripping of the newspaper takes place until it is positioned between the rollers 120, 122. Then, the upper rollers 120 snap down against the lower rollers 122, clamping the inserted leading newspaper portion L in the nip formed therebetween.

As seen in FIGS. 4 and 5, the clamping nip is formed at a level below that of the uppermost surface 164 of the leading tires 84*a*, 86*a* on the roller clutch and bearing assembly 64. It is also seen that the nip rollers 120, 122 are aligned generally to present depressed areas D on opposite sides of a central ridge area R in the newspaper section. Consequently, as the upper rollers 120 abruptly close down against the lower rollers 122, they snap the depressed areas of the newspaper section 12 down with them and further exaggerate the sharp central ridge R to enhance the angularity of the ridge. As shown in FIG. 5, this tends to leave only the sharp central ridge R of the bottommost paper 12 engaging in next newspaper section 12*a* thereabove, not only at the leading edge of the newspaper section 12 but also for its full fore-and-aft length and its side-to-side width. Consequently, not only is frictional contact between the superposed newspaper sections minimized, but also a sharpened central ridge R is formed in the bottommost newspaper section 12. With the extent of frictional contact between the adjacent sections reduced by virtue of the ridging effect, the quick, clean acceleration of the bottommost section 12 out of the stack by engagement with the high-speed nip rollers 120, 122 completes the withdrawal action as the feeder device 20 begins its return stroke by rearward movement as illustrated in FIG. 7. As the bottommost section 12 moves forwardly relative to the feeder device 20, the gripping needles 56 pivot in a clockwise direction against their springs 60 and the roller clutch and bearing assemblies rotate freely in a clockwise direction. Thus, substantial frictional engagement between the ridge-forming feeder device 20 is minimized when the bottommost section 12 accelerates by virtue of the nip rollers 120, 122. The center front retainer 24*a* is provided with an stop device 166 while the front retainers on either side thereof have facings 165 of friction resistant synthetic resin material such as ultra high molecular weight polyethylene oriented toward the newspaper receiving zone 22. The stop device 166 is adjustably mounted to the center front retainer 24*a* by a bracket 168 and setscrew 170, and includes a downwardly projecting finger 172 which is resiliently flexible and provided of a friction-resistent synthetic resin material such as ultra high molecular weight polyethylene. The finger 172 is designed to stop those newspapers sections in the stack 62 above the bottommost section 12.

The metering hopper 10 operates in conjunction and as a part of the newspaper assembling system previously disclosed in U.S. Pat. No. 4,911,421 referenced hereinabove. That system provides a central conveyor which moves newspaper sections therealong, with different sections being added by the use of drop hoppers or a succession of metering hoppers. A drive train associated with the conveyor provides a source of power to a single wrap clutch. The clutch is connected to a drive sprocket entrained on drive chain 104. The metering hopper 10 is provided with a selector switch for operating either in a continuous mode or an automatic mode. In the continuous mode, the clutch engages the sprocket for one turn, thereby driving chain 104 to reciprocate the feeder device 20 with corresponding actuation of the levers 132 and nip rollers 120, 122 each time a cam and follower detect a finger on the conveyor moving beneath the metering hopper 10 and provide an electric signal to a coil connected to the clutch. In the automatic mode, a sensor for the finger on the conveyor is operatively disconnected and an electric eye or other detector is operatively connected to the clutch. When operating in the automatic mode, the electric eye signals the coil to cause the clutch to engage for a single rotation of its attached sprocket to thereby drive chain 104 only when the electric eye detects a newspaper section 12 moving downstream along the conveyor. When an advancing newspaper section is detected, the clutch engages and chain 104 drives the feeder device 20 for one reciprocation with corresponding actuation of the levers 132 and nip rollers 120, 122.

A stack 62 of newspaper sections 12 is received in the newspaper receiving zone 22 of the metering hopper 12 above and supported by the feeder device 20. The stack 62 is positioned between the upright side retainers 26 and between the front retainers 24 and the rear retainer 28. It may be appreciated that a clearance is provided between the retainers and the stack 62 as the newspaper stack is roughly assembled and thus some fore-and-aft shifting is possible.

As the drive chain 104 is driven, large sprocket 106 is rotated, causing concurrent driving of endless chain 108, drive coupling 142 and shaft 102. The shaft 102 begins a single rotation turning crank 100 and moving link 94 to shift sleeve 90 along guide rod 88. Sleeve 90 carries with it support plate 44 and feeder device 20.

As feeder device 20 begins moving forwardly (to the left as viewed in FIGS. 3 and 4), needles 56 bite into the bottommost newspaper section 12 and pusher 48 engages the back end of the bottommost newspaper section to push it forwardly over roller clutch and bearing wheel assemblies 64 as shown in FIG. 6. The tires 84, 86 frictionally engage the lower side of the bottommost newspaper section 12 to impart forward movement because the roller clutch and bearing wheel assemblies 64 resist counterclockwise rotation as viewed in FIG. 6.

While the feeder device 20 moves forwardly during the feed stroke, the upper nip roller 120 and lower nip roller 122 begin rotating. Upper nip roller 120 is driven for counterclockwise rotation by chain 136 driven by sprocket 112 and driving sprocket 138. Lower nip roller 122 is driven in a clockwise direction by the movement of chain 108 entrained on sprocket 116 which engages chain 128 to drive shaft 124 secured for rotation with lower nip roller 122. The nip rollers 120 and 122 are driven at a higher speed than the feeder device 20 moves forwardly. Also, as the feeder device 20 is moving forwardly, the upper driven shaft 130 is snapped downwardly by the tension springs 140 connected to levers 132 when drive coupling 142 causes linkage 146 to permit rear ends 148 of levers 132 to move upwardly.

When the feeder device moves forwardly during its feed stroke from the position shown in FIG. 3 to that shown in FIG. 4, the nip rollers 120 bend the newspaper section 12 over the rail 46, and more particularly over the glide 47 of the feeder device 20. More particularly the roller clutch and bearing wheel assemblies 64 remain aft of a plane between the axes of rotation A, A' of the nip rollers 120 and 122 whereby the nip rollers bend the bottommost newspaper over the glide 47 on rail 46 to form ridge R, which is narrower and more aggressive than that formed by the metering hopper of the aforementioned U.S. Pat. No. 4,911,421. For example, the width W of the rail 46 is about only ¼ inch, in contrast to a three to four inch width of the rails and rubberized cap as shown in U.S. Pat. No. 4,911,421. The upper surface 164 of the 84 and 86 which engage the newspaper section 12 remain aft of the nip rollers throughout the reciprocating feed and return strokes of the feeder device 20. This serves to lock the contents of the newspaper section 12 together, and separate it from the newspaper section 12*b* immediately thereabove, which is held against forward movement by fingers 172 of front retainers 24. The bottommost newspaper section 12 also begins accelerating forwardly over feeder device 20 as the nip rollers 120 and 122 begin pulling on the leading edge of the newspaper. Thus, as illustrated in FIG. 7, the newspaper section 12 pivots needles 56 out of penetrating engagement and the newspaper section 12 rolls freely over roller clutch and bearing assemblies 64, which are free-turning in a clockwise direction.

As the newspaper section 12 begins moving forwardly by engagement with the nip rollers 120 and 122, the input drive shaft continues to turn and link 94 begins moving sleeve 90 and thus rail 46 rearwardly from the position shown in FIG. 4 back to that shown in FIG. 3 during the return stroke. Roller clutch and bearing wheel assemblies 64 continue to turn in a clockwise direction as the bottommost newspaper section 12 moves thereover and the next newspaper section 12*a* falls onto the feeder device. The feeder device 20 moves rearwardly until the pusher 48 is behind the next section 12*a*. The freewheeling rotation of the tires 84 and 86 during rearward movement of the feeder device 20 prevents shifting of the next section 12*a* rearwardly, thereby inhibiting the leading edge of third section 12*b* from moving down in front of the next section 12*a*. When the feeder device 20 is at the rearward position illustrated in FIG. 3, the levers 132 are in the raised position. The metering hopper 10 then awaits initiation of additional cycles caused by the movement of chain 104.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

I claim:

1. A newspaper hopper and feeder for sequentially feeding newspaper sections in a newspaper assembling system comprising:

structure defining a newspaper receiving area for holding a plurality of superposed newspaper sections;

drive means mounted on said holding structure; and a reciprocable feeder device for individually and sequentially feeding newspaper sections mounted to said drive means said drive means reciprocating said feeder device in a substantially linear path including a forward feed stroke and a rearward return stroke, said feeder device including an upright fore-and-aft oriented rail and a plurality of non-power-driven roller clutch and bearing wheel assemblies mounted on said rail for pushing frictional engagement with the bottommost newspaper section during a feed stroke and for free rotational movement while engaging the newspaper section during the return stroke.

2. A newspaper hopper and feeder as set forth in claim 1, wherein said drive means includes a guide rod fixed in substantially fore-and-aft orientation and a sleeve slidably mounted on said guide rod and coupled to said rail.

3. A newspaper hopper and feeder as set forth in claim 2, wherein said roller clutch and bearing wheel assemblies each include a tire mounted for engagement with the bottommost newspaper section.

4. A newspaper hopper and feeder as set forth in claim 3, including a first upper pair of spaced apart nip rollers and a second lower pair of spaced apart nip rollers positioned forwardly of an uppermost portion of said tires for bending the bottommost newspaper over the rail to form a ridge.

5. A newspaper hopper and feeder as set forth in claim 4, said rail including a synthetic resin glide mounted forwardly of said roller clutch and bearing assemblies to slidably receive the bottommost newspaper section thereon.

* * * * *